US008032986B2

(12) United States Patent
Lawrence

(10) Patent No.: US 8,032,986 B2
(45) Date of Patent: Oct. 11, 2011

(54) SELF ENCLOSED DISPOSABLE CARRY HANDLE

(76) Inventor: Patricia Lawrence, San Francisco, CA (US)

( * ) Notice: Subject to any disclaimer, the term of this patent is extended or adjusted under 35 U.S.C. 154(b) by 117 days.

(21) Appl. No.: 11/811,049

(22) Filed: Jun. 7, 2007

(65) Prior Publication Data

US 2008/0301910 A1 Dec. 11, 2008

(51) Int. Cl.
*A47B 95/02* (2006.01)

(52) U.S. Cl. ..... 16/114.1; 16/425; 16/407; 220/752; 220/759

(58) Field of Classification Search ..... 16/406, 16/411, 422, 425, 429, 444, 114.1, 430, 110.1; 206/428, 486, 494; 220/752, 754, 757, 759, 220/770; 229/117.24, 117.19
See application file for complete search history.

(56) References Cited

U.S. PATENT DOCUMENTS 2,179,037 A * 11/1939 Goldschmidt ..... 206/390
D175,751 S * 10/1955 Aleks ..... D8/317
D179,467 S * 1/1957 Aleks ..... D8/319
3,031,359 A * 4/1962 Blank et al. ..... 229/117.26
3,206,104 A * 9/1965 Cohen ..... 16/407
4,574,952 A * 3/1986 Masui ..... 206/494
5,080,281 A * 1/1992 Seabold ..... 229/117.22
5,145,108 A * 9/1992 Pinckney et al. ..... 229/117.26
5,467,915 A * 11/1995 Mattson ..... 229/117.24
6,126,009 A * 10/2000 Shiffler et al. ..... 206/494
6,513,657 B2 * 2/2003 Sheehan, Jr. ..... 206/497
6,701,571 B2 3/2004 Hagen

* cited by examiner

*Primary Examiner* — Victor Batson
*Assistant Examiner* — Emily Morgan
(74) *Attorney, Agent, or Firm* — Matlock Law Group, P.C.

(57) ABSTRACT

A self contained disposable bonded carry handle comprised of a layer of bonding material having a bottom side and a top side being coated with a pressure sensitive adhesive, said top side being coated with pressure sensitive adhesive about the periphery, at least one flexible handle having a first end and a second end affixed to the pressure sensitive adhesive on the top side of the bonding layer such that the center portion of the handle is movable and foldable, a protective layer affixed to the adhesive layer on the top side of the bonding layer, said protective layer having an opening to allow for access to the handle, and a surface layer having a centralized hole and a bottom layer substantially coated with pressure sensitive adhesive, said bottom layer affixed to the protective layer such that the handle passes through the centralized hole.

8 Claims, 3 Drawing Sheets

SELF ENCLOSED DISPOSABLE CARRY HANDLE

FIELD OF THE INVENTION

The present invention relates generally to material packaging and more particularly to handles used for packaging. Specifically this invention relates to a carry handle that is applied to a package using a pressure sensitive adhesive to allow for ease of carrying the package.

Modernly packaging is handled by automated equipment and is therefore designed to present smooth surfaces to the automation equipment for reducing the possibility of the package getting damaged during shipment. Unfortunately this prevents package manufacturers from building convenient handles on their packaging. Conventionally, on well constructed packages, perforated cutouts are stamped into the cardboard material such that one may punch out the perforated cardboard section and use the resulting hole as a carrying handle. This works well for thick cardboard, but does not work well for lighter weight material. Also these perforated cutouts are at fixed locations on the package. These fixed locations may make it difficult for one carrying the package to reach. Further, cost of custom boxes with cut out handles is financially out of line for many companies and is not an option for the individual.

BACKGROUND

In many circumstances, carrying a package may be awkward. For example, the weight, size, gripping and access means may not be convenient when two arms are wrapped around a package and a person is attempting to open doors, find car keys, push an elevator button, or other similar activities requiring multiple hands in addition to carrying the package. It can even be dangerous. Struggling with over-sized packages pulls the body out of alignment and balance, increasing the possibility of bodily injury. Gripping and carrying a package with both arms around the package also prevents a person from having a free hand to reach to steady themselves if they are informed or if on an unsteady surface caused by wet or slippery conditions caused by rain, ice or roughness or while navigating stairs or steep inclines. Unwieldy packages can lead to the dropping of the package. Dropping may cause breakage creating loss of contents, those often being irreplaceable. There is a need to solve the above and other problems to better grip, carry and position packages.

As such, a convenient method to attach a carry handle to a package such that it presents a smooth surface to automation equipment and can be easily attached at convenient locations on the package is needed.

Further, current package handle devices and methods of carrying packages do not allow a plurality of lengths and configurations of handle devices nor provide a flexible method to carry packages of a plurality of shapes and sizes. Such a device in a tandem configuration or varying lengths is also needed. Consumers currently have no low cost, disposable, flexible handle solution available for a wide array of uses or placement on package. Further, there is no existing, low cost disposable device currently available durable enough to maintain a useful life for the life of the package and available for a wide array of uses or placement on packages. Finally, a flexible and durable device with a high performance adhesive capable of carrying loads up to 50 lbs is needed.

SUMMARY OF THE INVENTION

Disclosed herein is a carry handle comprised of a layer of bonding material having a bottom side and a top side said bottom side being coated with a pressure sensitive adhesive, said top side being coated with pressure sensitive adhesive about the periphery leaving an elongated portion of the top side of the bonding material free of pressure sensitive adhesive, at least one flexible handle having a first end and a second end affixed to the pressure sensitive adhesive on the top side of the bonding layer such that the center portion of the handle is movable and foldable, a protective layer of a resin Polyethylene Terephthalate (PET) often called polyester film, sheet, MYLAR, or other appropriate pliable material affixed to the adhesive layer on the top side of the bonding layer, said protective layer having an opening to allow for access to the handle, and a surface layer of a resin Polyethylene Terephthalate (PET) often called polyester film, sheet, MYLAR, or other appropriate pliable material having an elongated hole and a bottom surface substantially coated with pressure sensitive adhesive, said bottom surface affixes to the protective layer, once release liner is removed and discarded, such that the handle passes through the centralized hole.

The invention disclosed herein is directed to a device and method to apply the device to a plurality of packages that allows any person an improved way to handle, carry and transfer a wide range of packages.

In a preferred embodiment of the present disclosure, a device with a strap handle comprising a low rise from the surface of the package for use with one hand is described.

In another embodiment, the invention disclosure reveals a device with a strap handle, a long rise from the package surface that can be slung over the shoulder or around the waist, like a belt, and carried at the side leaving both hands free.

In yet another embodiment, the invention discloses a handle device either in a tandem arrangement or a single device applied in tandem on the surface of a package with a medium to long rise from the package surface such that the package can be carried either with two hands, or by two people or carried over two shoulders similar to a backpack.

The construction and method of operation of the invention, however, together with additional objectives and advantages thereof will be best understood from the following description of specific embodiments when read in connection with the accompanying drawings.

DETAILED DESCRIPTION

Figure 1:
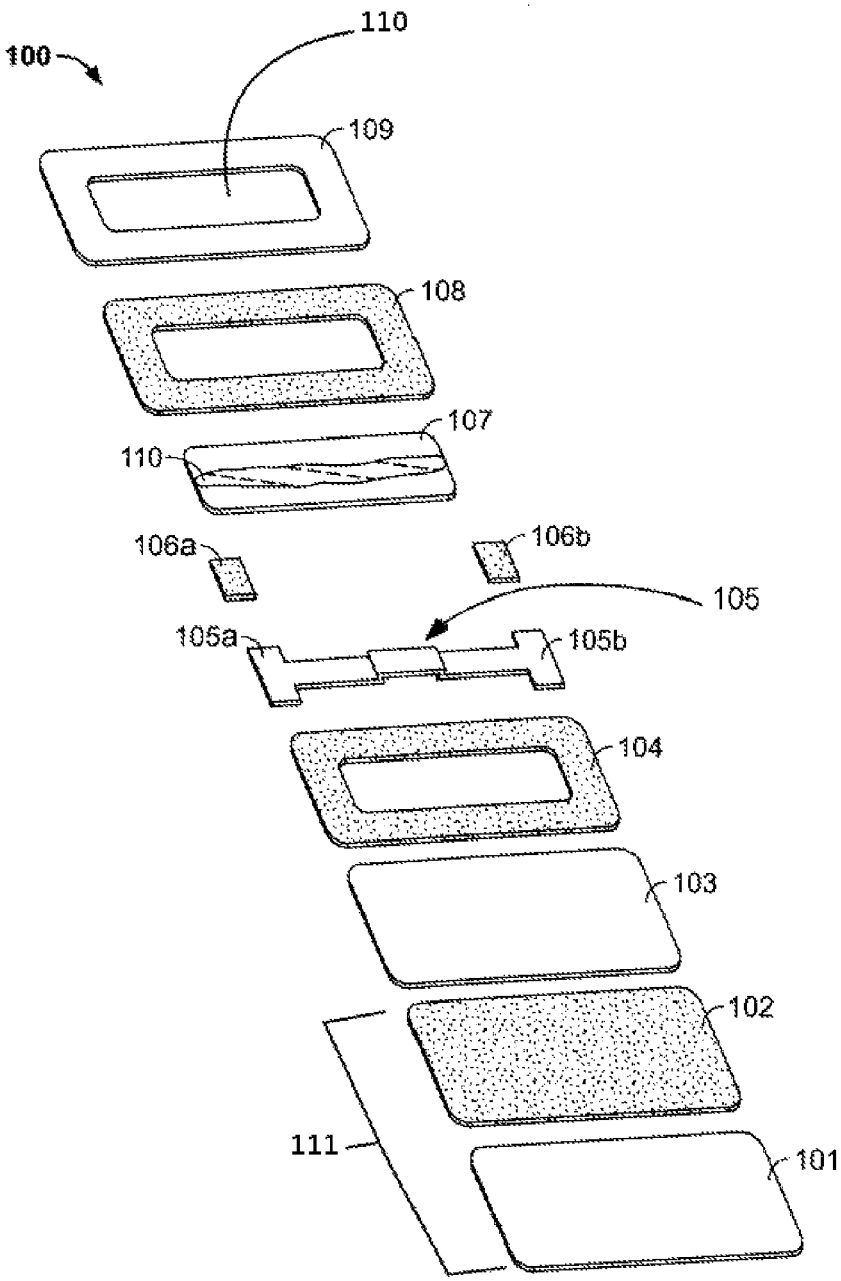
FIG. 1 shows a breakout drawing of one embodiment of the current invention.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 shows a breakout drawing of one embodiment of the carry handle_100. The bottom layer 111 is a release liner comprised of paper, or other appropriate light and disposable material 101 used for covering a first pressure sensitive adhesive (PSA) layer 102. The release liner is designed to provide a nonstick surface over an adhesive and can be peeled away from the first PSA layer 102. The PSA layer 102 is affixed to a bottom side of a bonding material 103. The bonding material 103 is comprised of a pliable tear-resistant polymer, layer or a synthetic material made of high-density polyethylene such as TYVEK. However other tear-resistant materials may be used. The bonding material 103 in turn has a second PSA layer 104 affixed to a top side of the bonding material 103. The second PSA layer 104 is disposed on the top side of the bonding material 103 in a manner to cover substantially the top side of the bonding material 103 leaving an elongated portion of the bonding layer 103 free of PSA material. The elongated portion can be substantially rectangular as shown, oval, or any other shape that serves the same purpose, as described below. The elongated portion is surrounded by a periphery portion.

A flexible handle 105 (shown folded) is comprised of a tear-resistant polymer, or a synthetic material made of high-density polyethylene such as TYVEK. However other tear-resistant materials may be used. The handle 105 is affixed to the second PSA layer at a first end 105*a* and a second end 105*b* such a center section of the handle may be unfolded in the center portion. The center section includes a folded middle handle, which can be unfolded and extended. The center section is narrower than the elongated portion. The first end 105*a* and the second end 105*b* are wider than the center section but are narrower than the bonding material 103. Thus the two ends 105*a* and 105*b* are bonded within the second PSA layer 104 on the periphery portion of the bonding material 103, and the two ends are bonded at opposite sides on the periphery portion. Thus, the center section of the flexible handle lies on top of the elongated portion and thus does not substantially come into touch with the second PSA layer 104._A top of the first end 105*a* of the handle 105 has a portion of a third PSA layer 106*a* affixed over it and a top of the second end 105 has also has a portion of the third PSA layer 106*b* affixed over it. A protective material 107 is affixed, over the flexible handle 105, atop the portions of the third PSA layer 106*a* and 106*b* as well as the exposed portion of the second PSA layer 104. The protective layer 107 is made from a resin Polyethylene Terephthalate (PET) often called polyester film, plastic sheet, MYLAR, or other appropriate pliable material. Thus the protective material 107 can be clear and the handle 105 can be visible to a user. The protective layer 107 is longer and wider than the elongated section, thus the protective layer covers over the entire flexible handle, covers the entire elongated section, and extends to the periphery portion. The protective layer 107 is not longer or wider than the bonding material 103 and does not lie beyond the boundary of the bonding material 103.

The protective material 107 is fabricated to provide an opening for the handle 105 to pass through when is it unfolded. The opening can be a substantially straight-line or wavy-line cut or perforation on the protective material. The top surface of the protective material 107 has a fourth PSA layer 108 disposed around the periphery to allow for the handle 105 to pass through when the handle 105 is unfolded. A tear-resistant_surface layer 109 is affixed to the fourth PSA layer 108. The surface layer comprised of a tear-resistant polymer, or a synthetic material made of high-density polyethylene such as TYVEK is constructed with the center portion 110 removed to allow for the handle 105 to pass through when unfolded. The surface layer 109 has an elongated hole that is substantially the same size and shape as the elongated portion, and corresponds in shape and position to said elongated portion on the bonding material. The Surface layer 109 is substantially the same size and shape as the bonding material 103 except for the elongated hole. The folded middle handle can be unfolded and extended, through the opening on the protective layer 107, through the elongated hole, used for carrying a package, and then folded and reinserted under the protective layer 107. The carry handle 100 has a smooth top surface when the folded middle handle is stowed below the protective layer 107. The smooth top surface facilitates contact with automated equipment.

Figure 2A:
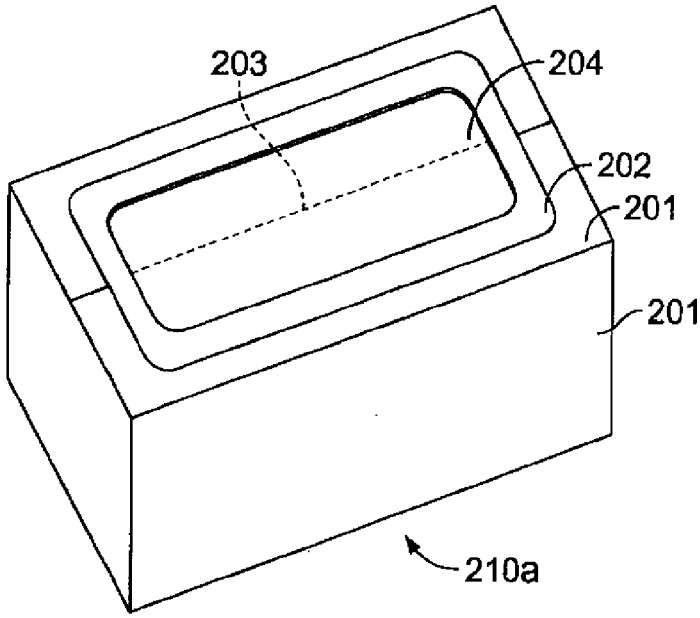
FIG. 2 shows the operation of the invention of FIG. 1.
Figure 2B:
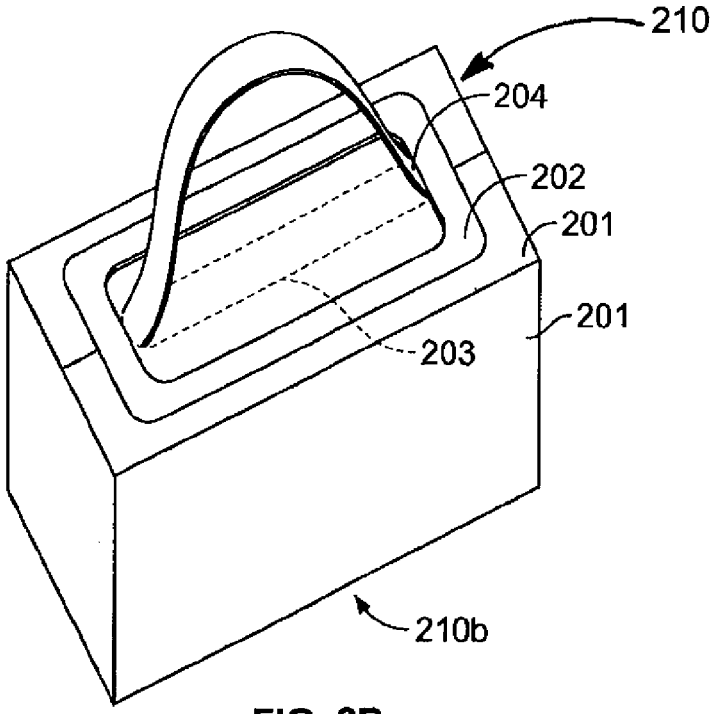

FIGS. 2A and 2B together show the operation of the invention of FIG. 1. In the FIG. 2A one embodiment of the current invention is affixed to a package 210*a* and 210*b* by removing the release liner comprised of paper, or light and disposable material 101 and exposing a PSA layer. The PSA layer is pressed against the package 210 affixing the current invention to the package 210*a* and 210*b*. The handle 204 is folded substantially flat and positioned under a protective layer 203. To use the handle 204, a user reaches through an access 202 in the protective layer 203. The access 202, 203 being constructed to substantially cover the handle 204 and to open sufficiently to allow the handle 204 to extend out of the access and unfold such that a user can grab the handle 204. In the FIG. 2B another aspect of the current invention is shown wherein the carrying handle is extended.

This device can be applied to a package prior to shipping. The enclosed handle can be extended, used for carrying the package, then reinserted into the attached covering, protecting the handle from catching on machinery or other objects during shipping, and then used on the recipient end by re-extending the handle from within the protective covering to carry the package to its final destination. This invention allows any person to apply the device to a wide variety of packages regardless of size and shape. They can then conveniently handle and carry that package with ease. Another advantage of this device is that it may be manufactured with varying handle lengths to allow for various methods for carrying the package.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Figure 3:
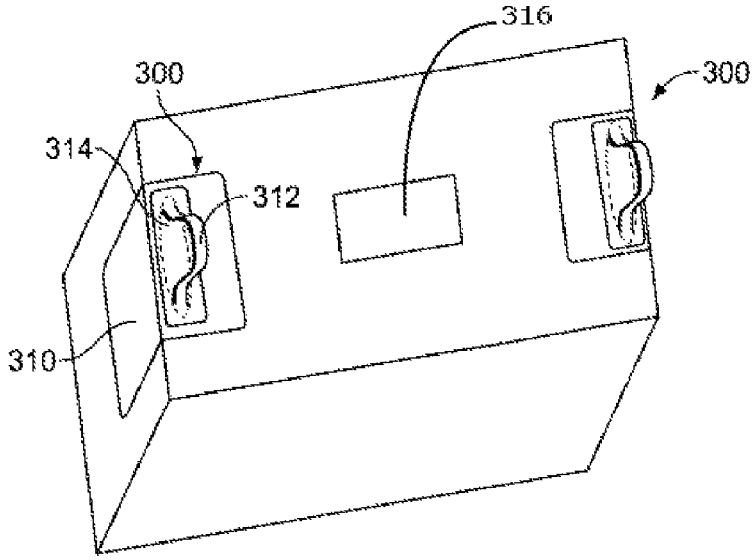
FIG. 3 shows another embodiment of the current invention for affixing on the corner of a package.

FIG. 3 shows another embodiment of the current invention 300 for affixing on both corners of a package. In this embodiment the invention is constructed similar to the embodiment of FIG. 1, however, the shape of the layers and position of the handle are disposed to allow for form fitting along the edge of a package. In this embodiment a handle 312 is shown unfolded from under a protective cover 314 said handle 312 disposed laterally along the edge of the package. This allows one person to use both hands, or two people to use one hand each to allow heavier weight. The identification marker 316 could be in the form of a bar code or an RFID chip that could be used in tracking. One having skill in the art would appreciate that differing shapes, positions and lengths of the invention are all within the scope and spirit of the current invention and disclosure.

Figure 4:
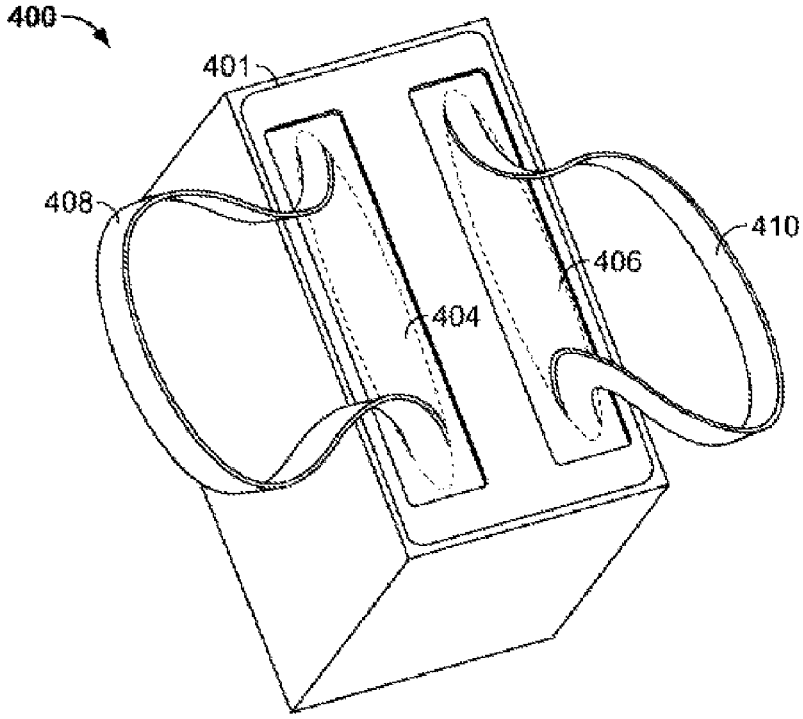
FIG. 4 shows yet another embodiment of the current invention having two handles.

FIG. 4 shows yet another embodiment of the current invention 400 having two handles. In this embodiment the invention is constructed similar to the embodiment of FIG. 1 with the exceptions described herein. A protective layer 401 is constructed with a first access 404 and a second access 406. Disposed beneath the first access 404 is a first handle 408. The first handle 408 is constructed to fold beneath the protective layer 401 and may extend through the access 404 by unfolding. Disposed beneath the second access 406 is a second handle 410. The second handle 410 is constructed to fold beneath the protective layer 401 and may extend through the second access 406 by unfolding. In this embodiment the invention may attach to a large package for handling by two people, or a person may wrap the first handle 408 and the second handle 410 around their shoulders, like a backpack, to facilitate carrying the package.

In another aspect of the present invention, the device may be designed with a high performance bonding ingredient to accommodate package loads of up to 50 lbs wherein said bonding ingredient is selected from a group consisting of adhesives, tape, or glue.

In another aspect of the present invention, the device will contain a release liner 101 that covers the bonding ingredient to preserve the bonding qualities during the useful life of the package itself to promote device durability. Further, said release liner further protects said bonding ingredient 102 from compromise prior to its application to the package itself.

In another aspect of the present invention, the extendable handle 204 will be self contained in an embodiment of the protective covering 203 that overlaps including either resealable adhesive, hook and loop bonding material, or an overlapped closure, comprising the outer panels of said device wherein said device is folded in a plurality of directions to present said outer panel to the interior cavity of said device upon its bonding to exterior surface of said package. First, the extendable handle is the only thing that can be self enclosed in the protective covering with the methods of securing the opening closed, as listed here, for additional security.

The device can be enclosed entirely in packaging for individual sale or distribution and additional embodiments of the devise can include on the protective layer itself additional means to secure the opening closed.

In another aspect of the present invention, an identification marker could be placed on either the handle itself or on the body of the base. This could be in the form of a Bar code or an RFID chip that could be used in tracking. The embedded chip could also be activated emitting a beacon when the handle is pulled for use. The chip could be either a passive or active function depending on the use of the device. It could also be used as an emergency beacon, in other embodiments. Those skilled in the art will recognize suitable means to implement these and other embodiments.

In yet another aspect of the invention, a further handle option in the form of a belt for the waist that could be fastened with either adhesive for a one time use or with "hook and loop" tape or a buckle for repeated use. Further, the waist belt handle could be used for emergency medical workers in emergency situations, or in public health settings, such as in a humanitarian medical environment where vaccinations are administered.

One having skill in the art would appreciate that differing shapes, positions and lengths of the invention are all within the scope and spirit of the current invention and disclosure. Different numbers of handles as well as lengths of handles may be incorporated in keeping with the spirit of the current invention and the invention may be constructed of different materials to provide for different package materials, shapes and weights.

In yet another embodiment of the invention, the protective covering will permit the device to be extended for use prior to shipping, reinserted securely inside the protective covering and re-extended upon delivery for ease of carrying.

In other embodiments the materials used allow for customization of the handle through printing or other embellishment. The customization could include logos, trademarks, motor, slogans, identifying colors, shipping or handling instructions, sender's/recipient's address and any number of other configurations.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A carry handle comprised of:

a layer of tear-resistant bonding material having a bottom side and a top side, and having a width and length, wherein said bottom side is coated with a first pressure sensitive adhesive layer, and wherein a periphery of said top side is substantially coated with a second pressure sensitive adhesive layer;

at least one tear-resistant flexible handle having a first end, a second end, and a folded center section having an I-shaped plan view, wherein said center section is narrower than said bonding material;

wherein said first end and said second end are wider than said folded center section;

wherein said first end and said second end are affixed to the second pressure sensitive adhesive layer on the top side, positioning the folded center section within the periphery of the bonding material;

wherein said handle is movable;

a third pressure sensitive adhesive layer affixed to the top side of said first end and second end, wherein said third pressure sensitive adhesive layer is of the same size as said first end and said second end such that said third pressure sensitive adhesive layer is not affixed to said center section;

a protective layer affixed to said second pressure sensitive adhesive layer and said third pressure sensitive adhesive layer, said protective layer having at least one opening to allow for access to the at least one flexible handle;

a tear-resistant surface layer having a centralized hole and a bottom surface substantially coated with a fourth pressure sensitive adhesive layer, wherein the bottom surface of said fourth pressure sensitive adhesive layer is affixed to the top side of the protective layer such that the folded middle handle is capable of passing through the centralized hole;

wherein said surface layer is substantially the same size and shape as said periphery of said bonding material; and wherein said surface layer increases capacity of said handle;

wherein the folded middle handle can be extended through the centralized hole, and then reinserted under the protective layer after use; and wherein a smooth top surface is created when the folded middle handle is under the protective layer, wherein said smooth top surface facilitates contact with automated equipment.

2. The carry handle of claim 1 wherein the protective layer is transparent.

3. The carry handle of claim 1 further comprising a layer of release liner affixed to the bottom side of the bonding material such that the pressure sensitive adhesive on the bottom side of the bonding material is exposed when the release liner is removed, wherein the handle can be extended, used for carrying a package, then reinserted under the protective layer, protecting the handle from catching during shipping, and then reused by re-extending the handle from within the protective layer.

4. The carry handle of claim 1 wherein the surface layer includes one or more materials selected from the group consisting of a resin Polyethylene Terephthalate (PET) often called polyester film, and plastic sheet.

5. The carry handle of claim 1 wherein the protective layer is transparent.

6. The carry handle of claim 1 wherein the carry handle does not require the different layers to be heat sealed together in order to accommodate package loads of up to 50 pounds.

7. The carry handle of claim 1 wherein the bonding material and surface layer includes high-density polyethylene.

8. A carry handle comprised of:

a layer of tear-resistant bonding material having a bottom side and a top side, said bottom side being coated with a first pressure sensitive adhesive layer, said top side being coated with a second pressure sensitive adhesive layer such that pressure sensitive adhesive layer is about the periphery of said top side leaving the center of the top side of the bonding material free of pressure sensitive adhesive;

at least one tear-resistant flexible handle having a first end, a second end, and a folded center section, said first end and second end coupled to said center section to form said tear-resistant flexible handle having an I-shaped plan view wherein said first end and said second end have a second width and said center section having a first width, wherein said second width is greater than said first width, wherein said second width is smaller than the width of the bonding material;

wherein said first end and said second end are affixed to the second pressure sensitive adhesive layer on the top side of the bonding material such that the center portion of the handle is movable, and wherein said first end and second end are further affixed to a third pressure sensitive adhesive layer, said third pressure sensitive adhesive layer being of the same size of said first end and said second end such that said third pressure sensitive adhesive layer is not affixed to said center section;

a protective layer affixed to the adhesive layer on the top side of the bonding material, said protective layer having an opening to allow for access to the handle, said protective layer being wider and longer than said center portion of the handle, and said protective layer covers said first end and second end;

a tear-resistant surface layer having a centralized hole and a bottom surface substantially coated with a fourth pressure sensitive adhesive layer, said centralized hole being smaller than said protective layer, said surface layer being larger than said protective layer, said bottom surface affixed to the protective layer such that the handle can pass through the centralized hole and wherein the handle can be extended, and then reinserted into the protection layer, simultaneously protecting the handle from catching during shipping, and then reused by re-extending the handle from within the protective layer;

wherein said surface layer increases the capacity of the handle; and wherein a smooth top surface is created upon affixing the bottom surface of the tear-resistant layer to the protective layer, wherein said smooth top surface facilitates contact with automated equipment.

* * * * *